US005822921A

United States Patent [19]

Griepenstroh et al.

[11] Patent Number: 5,822,921

[45] Date of Patent: Oct. 20, 1998

[54] DOOR WITH BIASING WINDOW REGULATOR

[75] Inventors: Bruce A. Griepenstroh, Middlebury, Ind.; Darren M. Grumm, Cassopolis, Mich.; Michael D. Kobrehel, Elkhart; James A. Molitor, Bristol, both of Ind.; Clayton E. Flanagan, Niles, Mich.

[73] Assignee: Excel Indusries, Inc., Elkhart, Ind.

[21] Appl. No.: 928,223

[22] Filed: Sep. 12, 1997

Related U.S. Application Data

[63] Continuation of Ser. No. 667,983, Jun. 19, 1996, abandoned.

[51] Int. Cl.[6] ..... E05F 11/44

[52] U.S. Cl. ..... 49/350; 49/349

[58] Field of Search ..... 49/348, 349, 350, 49/351, 502

[56] References Cited

U.S. PATENT DOCUMENTS

| | | | |
|---|---|---|---|
| 2,201,004 | 5/1940 | Chandler et al. | 49/351 |
| 2,212,220 | 8/1940 | Zwierzina | 49/351 X |
| 2,291,275 | 7/1942 | Ackerman | 49/351 X |
| 2,409,068 | 10/1946 | Roethel | 49/351 X |
| 3,231,301 | 1/1966 | Gray | 49/351 X |
| 3,449,861 | 6/1969 | Lecomte . | |
| 3,816,962 | 6/1974 | Ladd et al. . | |
| 4,174,865 | 11/1979 | Doveinis | 49/351 X |
| 4,222,202 | 9/1980 | Pigeon . | |
| 4,235,046 | 11/1980 | Hess et al. . | |
| 4,353,185 | 10/1982 | Saigne | 49/351 |
| 4,468,887 | 9/1984 | Koch . | |
| 4,794,733 | 1/1989 | Kanemaru . | |
| 4,827,671 | 5/1989 | Herringshaw et al. . | |
| 4,970,827 | 11/1990 | Djordjevic . | |
| 4,991,348 | 2/1991 | Yamamura et al. . | |
| 4,991,351 | 2/1991 | Bertolini . | |
| 5,027,555 | 7/1991 | Halliwell | 49/351 |
| 5,086,586 | 2/1992 | Hlavaty et al. . | |
| 5,101,596 | 4/1992 | Moore . | |
| 5,116,620 | 5/1992 | Lau et al. . | |
| 5,263,282 | 11/1993 | Cooper et al. . | |
| 5,337,519 | 8/1994 | Bergesio . | |
| 5,355,629 | 10/1994 | Kimura et al. . | |
| 5,367,832 | 11/1994 | Compeau et al. . | |
| 5,398,449 | 3/1995 | Kobrehel et al. . | |
| 5,537,781 | 7/1996 | Bisnack et al. | 49/351 |

*Primary Examiner*—Jerry Redman
*Attorney, Agent, or Firm*—Banner & Witcoff Ltd

[57] ABSTRACT

A rotationally biasing window regulator for controlling the motion of a windowpane, such as a windowpane in a motor vehicle door or door module, comprises a motor or hand crank to produce a force to move the windowpane, drive arm and a sector gear to transmit the force, an attachment assembly attached to the windowpane and a slider assembly slidingly attached to the attachment assembly and mounted over the drive arm, and a counterbalance spring positioned between the attachment assembly and the drive arm placing rotational force on the slider assembly, which directly biases the attachment assembly to force the windowpane in a lateral direction towards a glass run channel. The slider assembly can slide in a stamped metal bracket or in a C-channel. A clip connecting the attachment assembly to the drive arm may be used to releasably secure the regulator in a said position. In alternative preferred embodiment, a pre-assembled door module for installation into a motor vehicle door is provided with a biasing window regulator placing rotational force on a windowpane. The windowpane may optionally be attached to the door module as a complete unit prior to final assembly, and may be installed into the vehicle door through a door module opening below the beltline.

24 Claims, 8 Drawing Sheets

DOOR WITH BIASING WINDOW REGULATOR

This application is a continuation of application Ser. No. 08/667,983, file Jun. 19, 1996, now abandoned.

FIELD OF THE INVENTION

The present invention is directed to improved regulators for controlling the position of a windowpane. More particularly, the invention is directed to window regulators that place rotational or biasing force on the windowpane to control the motion or position of the windowpane in lateral directions and to doors and door modules incorporating such regulators.

BACKGROUND

Window regulators, such as for a vertically moveable side window in the door of a motor vehicle, take a variety of forms. Typically the motion of the windowpane must be controlled by the regulator in conjunction with and run channels, etc., in six directions. In the example of a side window of a motor vehicle, the windowpane must be controlled in up-down, lateral or fore-aft, and inboard-outboard directions. One type of window regulator is known as an arm-and- sector window regulator. These window lift systems typically include a drive means having a hand crank or an electric motor, and a drive pinion which rotates in response to force from the motor or hand crank, a sector gear rotatably meshing with the drive pinion, and a drive arm attached at one end to a channel fixedly connected to the windowpane and attached at a second end to the sector gear. To establish a generally straight line travel path in a door of conventional styling, the drive arm is typically slidably attached to the windowpane. Thus, a roller, slider or glider is typically rotatably attached at the first end of the drive arm to roll or slide in a slide or C-channel fixedly attached to the windowpane.

Operation of the drive means in one direction places rotational force on the sector gear which is translated to vertical travel force via the drive arm and slide channel arrangement to raise and lower the windowpane. The window regulator provides the principal control of the windowpane in the up-down directions.

Inboard-outboard motion of the windowpane is restricted in part by the C-channel that the slider slides in, and in part by a pair of vertical glass run channels positioned along the fore and aft vertical edges of the windowpane. During operation of the regulator, the windowpane moves relative to both the door and the drive arm between a full up position to a full down position. The vertical glass run channels act to control fore and aft or lateral motion to some degree, especially when the windowpane is in the full up position. However, assembly problems and styling concerns control the configuration and alignment of the run channels such that the run channels are seldom aligned parallel with one another. Furthermore, due to space constraints inside the vehicle door, many regulator designs do not extend the run channels the full length of the travel path of the windowpane. Consequently the glass run channels often are a progressively less effective guide as the windowpane slides down from the full up position.

A single arm regulator will not adequately control the windowpane laterally, that is, in the fore and aft directions, and will impart a tilting force unless positioned directly below the center of gravity of the windowpane. Moreover, if the glass run channels are not parallel or do not continue the length of the travel path of the windowpane, the run channels will not adequately control the fore and aft movement of the windowpane. Without additional control this can result in an aesethically unappealing tipping of the windowpane known as wobble or chatter. This is essentially rotation of the windowpane in its plane of travel such that its top edge is to far forward or back. In addition, the potential exists for jamming of the windowpane into one of the run channels if the windowpane tips to far in one direction.

Known efforts to control motion of the windowpane in the fore and aft directions have included adding a second, stabilizing arm, known as a cross-arm. Typically in these cross-arm regulator designs the stabilizing arm is pivotably attached to the first arm and is provided with rollers, sliders or gliders rotatably attached at each end of the arm, each rolling or sliding in a C-channel. Typically the slider at one end of the cross-arm slides in the same C-channel as the slider on the dive arm, and the slider at the other end of the cross-arm slides in a separate equalizer C-channel mounted to a backplate or other similar support structure mounted on the door. Multiple sliders siding in C-channels provide greater stability, minimizing tipping or chattering. However, the stabilizing effect is minimized near the full up and full down positions where the two sliders are positioned near one another. Moreover, addition of the cross-arm with the sliders and the extra C-channel greatly increases the cost and complexity of the regulator design.

In addition, with existing designs C-channels are greatly preferred over a lift channel created by stamping an opening in a metal plate and crimping or bending over the edges to create a slot for a modified slider to slide in. This is because it is difficult to control the tolerances of the slot and the crimped edges of the metal. Out of tolerance stamped slots can cause rattling and chatter in the regulator between the metal plate and the poorly controlled slider.

Other known efforts to control the motion of the windowpane in the fore and aft directions include the use of generally vertical guide rails mounted to a support structure, such as the inner panel of a door, and a channel bracket provided with low friction surfaces that glide over the guide rail. This design is often referred to as a tube-and-shoe regulator. The tube is the rail and the shoe is typically a low friction material injection molded onto the bracket. The shoe sliding over the tube acts to restrict the fore and aft motion of the windowpane as it moves from the full up to the full down positions, preventing tipping. The drive arm slides in a C-channel fixedly attached to the channel bracket. Cost, complexity and assembly time are all greatly increased by addition of the tube, which typically requires upper and lower mounting brackets to be attached to the inner panel of the door, and of the channel bracket, as well as with the extra manufacturing step of injection molding a shoe.

Gravity assists movement of the windowpane as it moves from the closed, full-up position to the open, down position. In current production window regulator designs, particularly those employing an electric motor as drive means, it is preferable that the loading on the motor is generally equal in both the up and down directions. To counter gravity, a counterbalance spring may be employed to equalize the loading on the motor between the up and down cycles. Typically one end of the spring is mounted on the drive arm near the second end close to the sector gear and the other end is mounted to a rigid backplate. At the full up position, the counterbalance spring has a minimum of potential energy. As the windowpane lowers and the drive arm moves relative the backplate, the potential energy in the spring increases until the windowpane reaches the full down position. As the windowpane moves up, the spring transmits its stored energy to the drive arm, and from there to the windowpane, counteracting the force of gravity and producing generally equivalent loading on the motor. To minimize the size of the spring, the counterbalance spring must be mounted near the pivot point of the drive arm, since the drive arm will move relative the backplate. However, positioning the spring between the drive arm and the backplate does not control the motion of the windowpane in the fore and aft directions as the windowpane can slide relative the drive arm.

It is an object of the present invention to provide a window regulator of improved design which, especially in preferred embodiments, is easy to manufacture and to assemble, and reduces complexity and cost while providing control of the windowpane in all directions. It is a further object of the present invention to provide a door with such a window regulator of improved design which provides control of the windowpane in all directions compatible with current motor vehicle assembly techniques. It is another object of at least certain preferred embodiments of the present invention to provide a door module of improved design and manufacturability which may be assembled into an opening in a motor vehicle door. Additional objects and features of the invention will become apparent from the following disclosure taken together with the detailed discussion of certain preferred embodiments.

SUMMARY

In accordance with a first aspect, a regulator for controlling the motion of a windowpane, such as for example a vertically moveable side window in the door of a motor vehicle, is provided with rotational drive means, such as a motor or manual hand crank, drive transmission means for transmitting the rotational force of the drive means to the windowpane, attachment means for connecting the drive transmission means to the windowpane, and a spring or other suitable biasing means operatively connected between the drive transmission means and the attachment means, with the spring producing a rotational biasing force which is exerted directly or indirectly against the attachment means, causing the windowpane to be biased in a lateral direction, that is, in its plane of travel. The biasing means may be any of several kinds of springs, including a spiral or counterbalance spring, a torsion spring or a leaf spring.

In those preferred embodiments using an arm-and-sector type regulator the drive transmission means would include an arm and sector assembly transmitting the rotational force of the drive means to raise and lower the windowpane, comprising a sector or quad gear rotatable by the drive means and a drive arm extending from the sector gear to the attachment means which is in turn attached to the windowpane.

In certain preferred embodiments the attachment means between the drive arm and the windowpane may include an attachment assembly and a slider assembly. The attachment assembly can comprise a windowpane mounting bracket fixedly secured to the windowpane and a lift channel for receiving the slider assembly fixedly secured to the bracket preferably comprising a simple metal plate with a stamped opening. In such embodiments the slider assembly comprises a slider, sliding in a slot in the lift channel and rotatably attached to the drive transmission means by a pivot pin. The slider in a slot in a metal stamping in known designs was noted to be disadvantageous because of problems with rattling with out-of-tolerance component parts. In accordance with preferred window regulator designs disclosed here this problem is reduced or eliminated because the spring or bias means continually produces a force on the slider in the slot.

In those embodiments using a spiral or counterbalance spring, the spring can be mounted at a first end over a pivot pin, and at a second end of the spring may engage the slider. The spring will apply torque to the slider, causing the attachment assembly and windowpane to be biased laterally. Since the spring is mounted over the pivot pin the spring will slide with the slider assembly relative the fixed elements of the attachment assembly. It should be understood that reference to the windowpane being laterally biased means that the windowpane would rotate until the energy in the spring was released were the windowpane not trapped in the vertical run channels. Therefore, the top edge of the windowpane will be subjected to a biasing force towards one or the other of the run channels.

In accordance with certain alternative preferred embodiments of the arm-and-sector type having a spiral or counterbalance spring as the bias means, the attachment assembly has a windowpane mounting bracket and a C-channel affixed to the mounting bracket, and the slider assembly has a glider plate with at least one roller or slider attached to an outboard side of the glider plate and rolling or sliding in the C-channel. The drive arm is attached to a pivot pin and the spring is attached at one end around the pivot pin. The pivot pin can be adjustably rotatable relative to the glider plate. The other end of the spring has a hook segment sized to fit on a spring retaining pin attached to the glider plate. The pivot pin may be capped or spin welded to secure the spring to the drive arm. Alternatively the plate may have a cage or spring mounting recess positioned around the spring to minimize movement of the spring, with an opening to rotatably receive the pivot pin.

In accordance with certain other alternative preferred embodiments, instead of being fixedly attached as part of the attachment assembly, the C-channel may be part of the slider assembly, affixed to the glider plate, and the attachment assembly can have at least one roller or slider rotatably attached to the windowpane mounting bracket and sliding or rolling in the C-channel.

In a highly advantageous feature greatly enhancing the ease of assembling the regulator into the door, the regulator may be secured in a ship position with a locking means, such as, for example a pin or screw insertable into an opening in the drive arm and locked to the slider assembly. When the windowpane is installed, for example into a motor vehicle door, and attached to the regulator, the screw or pin may be removed, allowing torque to be applied to the windowpane, rotationally biasing the windowpane laterally in its travel plane from its ship position or condition toward an operating position or condition.

In accordance with another aspect, the door of a motor vehicle having an inner panel welded or otherwise rigidly attached to an outer panel is provided with a pair of generally vertical glass run channels. A windowpane having a top edge and a bottom edge travels from a full up to a full down position between the run channels. Drive means, such as a motor or hand crank, produce a rotational force which is transmitted to an attachment bracket fixedly attached to the windowpane via drive transmission means, for example, an arm-and-sector assembly as described above. A spring is mounted on the drive arm of the regulator, placing torque on the attachment means as described above thereby biasing the top edge of the windowpane laterally in the travel plane towards one of the glass run channels. Other door components such as speakers, interior trim paneling, hinges, latch, lock, handles and weatherstrips would be assembled in a manner known to those skilled in the art.

In accordance with yet another aspect, a pre-assembled door module includes the windowpane and a window regulator with a spring or other biasing means for biasing the windowpane rotationally in its travel plane. The door module can be aligned in a ship position and held there until the module is installed in the door. Holding the door module in the ship position allows for greatly improved ease in assembly of the windowpane to the rest of the module, and allows assembly of the door module with the windowpane from below the so-called beltline, or bottom of the window opening in the vehicle door. Preferably, other door module components such as lock and latch components, intrusion beams, and electrical wiring harnesses would be assembled to the door module prior to installing the module into the door.

From the foregoing disclosure and the following more detailed description of various preferred embodiments it will be apparent to those skilled in the art that the present invention provides a significant advance in the technology and art of motor vehicle window regulators, doors and door modules. Particularly significant in this regard is the potential the invention affords for reduced cost and complexity while maintaining control of motor vehicle windowpanes. Additional features and advantages of various preferred embodiments will be better understood in view of the detailed description provided below.

BRIEF DESCRIPTION OF THE DRAWINGS

Certain preferred embodiments are discussed below with reference to the appended drawings wherein.

Figure 1:
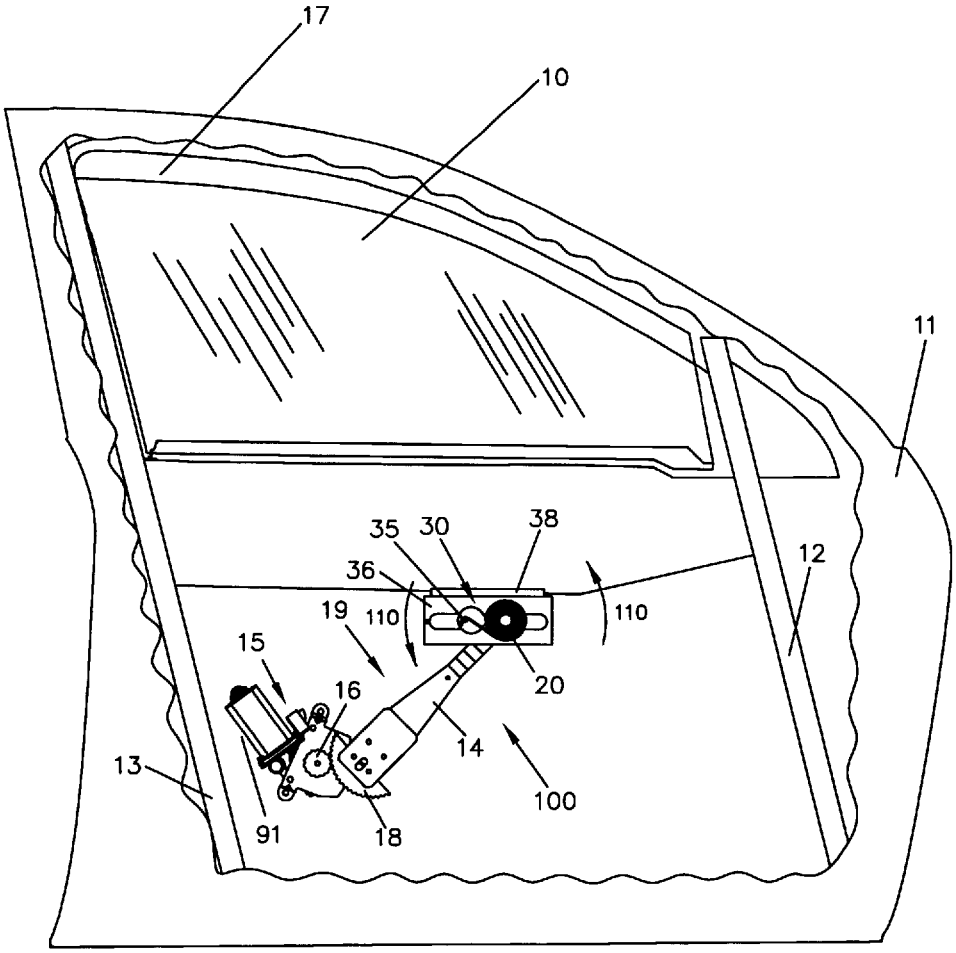
FIG. 1 is a schematic elevation view of a vehicle door defining a window opening which is closed by a vertically slidable windowpane controlled by a rotationally biasing window regulator in accordance with a preferred embodiment.

It should be understood that the appended drawings are not necessarily to scale, presenting a somewhat simplified representation of certain preferred embodiments illustrative of the basic principles of the invention. The specific design of rotationally biasing window regulator, door and door module assemblies in accordance with the invention, including, for example, the specific configuration and dimensions of various components, including the attachment means for connecting the drive transmission means to the windowpane, will be determined in part by the intended application and use environment of the regulator assembly. Certain features of the rotationally biasing window regulator, door and door module assemblies have been enlarged or distorted relative to others to facilitate visualization and clear understanding. In particular, thin features may be thickened, for example, for clarity of illustration. All references to direction and position, unless otherwise indicated, refer to the orientation of the window regulator assemblies illustrated in the drawings. In general the glass run channels will be considered extending substantially vertically and directions to the right and left of the windowpane in the plane of the paper in FIG. 1 will be referred to as lateral or fore and aft directions. The directions normal to the plane of the paper in FIG. 1 are inboard/outboard. The terms "biasing force", "rotational force", and "torque" may be used interchangeably to refer to the efforts produced by the biasing means on other components unless otherwise clear from the context. It should be understood that rotationally biasing window regulator, door and door module assemblies in accordance with the invention can be used in diverse applications.

DETAILED DESCRIPTION OF CERTAIN PREFERRED EMBODIMENTS

It will be apparent to those skilled in the art, that is, to those who have knowledge or experience in this area of technology, that a rotationally biasing window regulator having a spring or other biasing means for placing rotational force either directly or indirectly on a windowpane to bias the windowpane rotationally in its travel plane, (i.e., in a lateral direction) may be used in numerous window regulator, door and door module design variations. The following detailed discussion of various alternative and preferred features and embodiments will illustrate the general principles of the invention by example of an arm-and-sector type window regulator used in motor vehicle doors. Other embodiments suitable for other particular applications, such as cable-drum window regulator designs, will be readily apparent to those skilled in the art. The discussion below focuses on arm-and-sector regulator assemblies wherein the windowpanes are opened and closed by vertical sliding action with the ground, but the design and operating principles are applicable generally to windows which have alternative open/close directions.

Figure 2:
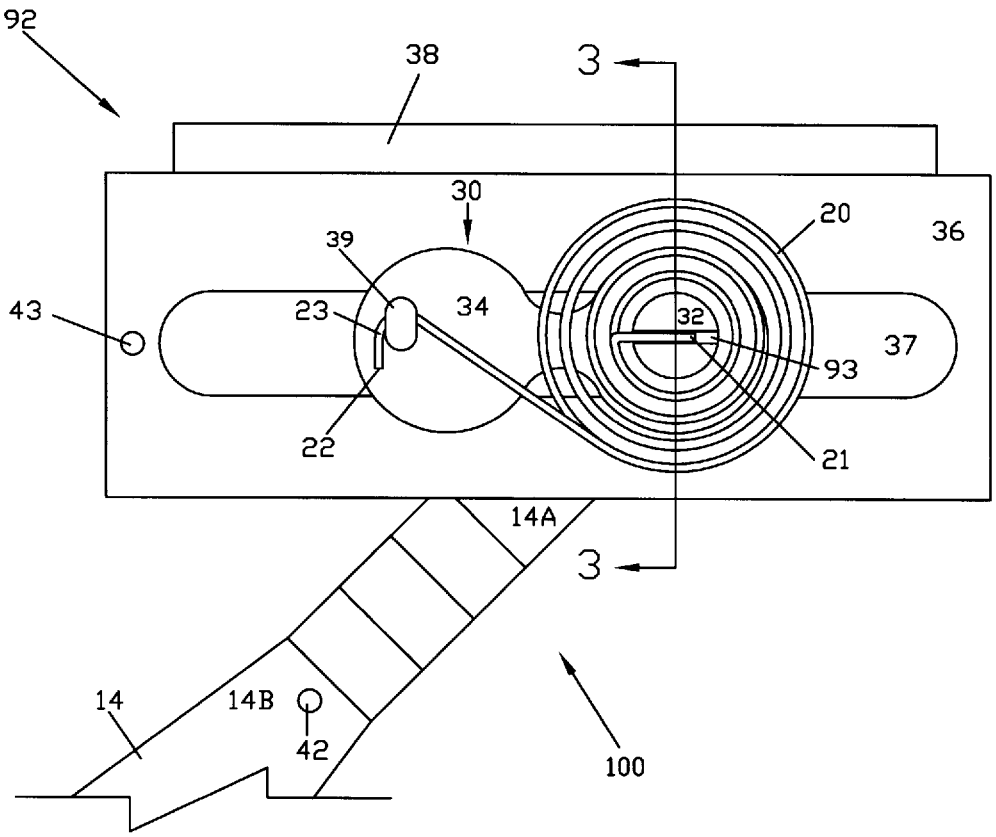
FIG. 2 is a schematic view of the drive arm-to-windowpane connection of the rotationally biasing window regulator of FIG. 1.
Figure 3:
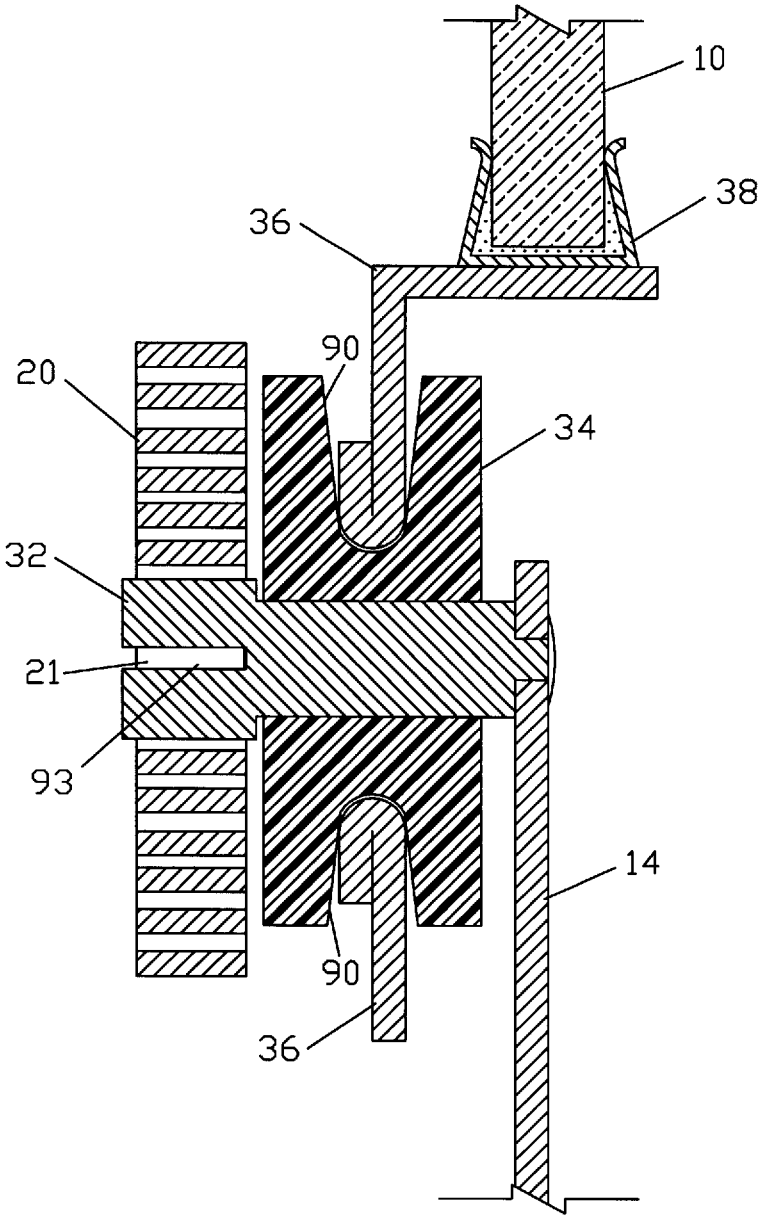
FIG. 3 is a cross section view taken along line 3—3 in FIG. 2.

Referring now to the drawings, FIGS. 1–3 reveal a motor vehicle door 11 having a rotationally biasing window regulator 100 in accordance with a first preferred embodiment of the invention. The motor vehicle door 11 has an opening 17 closed by a generally vertically slidable windowpane 10 having a top edge and a bottom edge. A pair of laterally spaced generally vertical run channels 12,13 are positioned laterally on either side of the windowpane 10. The windowpane is vertically moveable between the run channels from an up position in which it closes the opening 17 to a down position in which it does not close the opening 17. Drive means 15 for raising and lowering the windowpane 10 include a motor 91 or hand crank and a drive pinion 16 which rotates in response to force from the motor 91. Actuating means for selectively actuating the drive means may be used, such as a switch or button in the case of a window regulator with a motor. The drive transmission means for transmitting the force of the drive means 15 is shown in this preferred embodiment to comprise a sector gear 18 rotatably meshing with the drive pinion 16, and a drive arm 14 having a pair of ends, attached to a slider assembly 30 near a first end and attached to the sector gear near a second end.

Attachment means 92 for connecting the rotationally biasing window regulator 100 to at least part of the bottom edge of the windowpane 10 preferably includes a windowpane mounting bracket 38 and a lift channel comprising a metal plate 36 with an opening stamped into the center of the plate to define a lift channel slot 37. The slider assembly 30 slides in the slot 37. The slider assembly 30 in this embodiment is seen to comprise a slider 34 and a pivot pin 32. Preferably the slider is generally dog-boned shaped as viewed from the inboard and outboard sides, so as to be in contact with the plate 36 in at least 2 locations on the top of the slot 37 and at least two locations on the bottom of the slot 37. The slider 34 has lift channel receiving valleys 90. The valleys nest over the lift channel plate 36 at the slot 37.

In designs where the door 11 is somewhat curved from top to bottom, as is commonly the case in current production motor vehicle designs, the windowpane glass must be curved to track the shape of the door. Since the windowpane glass must travel in a curved path, the drive arm in an arm-and-sector type window regulator assembly will be subjected to inboard-outboard torsional loading. It should be understood that reference here to a windowpane traveling in a vertical or other "travel plane" is intended to include such curvo-planar travel planes. In a highly advantageous feature of this invention, torsional loading on the drive arm 14 is minimized by shaping the valleys 90 such that they allow for some pivoting motion of the windowpane 10 and attachment means 92 relative the drive arm 14 as they cycle from the up position to the down position.

Prior to complete assembly the slot 37 may optionally extend all the way to one end of the lift channel 36 allowing for insertion of the slider 34 from that end. To provide enhanced structural strength and to complete assembly of these components of the rotationally biasing window regulator, the open end of the run channel bracket 36 may be staked over and spot welded together to close the run channel 37. Alternatively the slider 34 may be of a 2 piece construction, with an inboard segment snap fitting into an outboard segment, locking the slider 34 into the slot 37, eliminating the need for an open-ended lift channel.

As is best shown in FIG. 3 the slider 34 is connected to the drive arm 14 by a pivot pin 32. The pivot pin 32 is preferably rotatably attached to the first end of the drive arm 14 and to the slider 34 to allow for relative motion of the drive arm 14 and the slider 34 as the windowpane 10 moves up and down. Optionally a cylindrical or journal bearing can be employed between the pivot pin and the slider to facilitate relative motion between these components. A spring, preferably a spiral or counterbalance spring 20 has a pair of ends 21, 22. In a highly advantageous feature, the spring is operatively connected between the first end of the drive arm 14 and the attachment means 92 biasing the attachment means 92 relative the drive arm 14. The spring 20 is mounted at a first end over a receiving channel 93 in the pivot pin 32. In certain preferred embodiments, the second end of the spring 22 has a hook shaped portion 23 and is mounted under loading over a second pin 35 mounted on the slider 34. The second pin 35 acts as a spring catch. The spring places rotational force on the slider 34 which biases it in the slot 37 against the lift channel 36. The attachment means 92, comprising the lift channel 36 and the windowpane mounting bracket 38 are then subjected to the spring generated torque and the windowpane 10 is biased laterally. Thus the drive arm 14, run channels 12,13 and spring 20 cooperate to control the motion of the windowpane 10 in all three dimensions. To satisfy stringent motor specifications in the automotive industry, optionally a second spring may be mounted between a backplate or similar mounting structure rigidly attached to the door and the drive arm near the pivot point of the drive arm. The second spring exerts a force on the drive arm opposite gravity to generally equalize the loading on the motor between an up cycle where the motor fights gravity and a down cycle where motor is assisted by gravity.

Given the design of current windows for motor vehicles the top edge of the windowpane 10 will typically and preferably be biased towards the glass run channel aft or rearward of the windowpane. The spring biases the top edge of the windowpane 10 in a clockwise direction 110 in the embodiment shown in FIG. 1, towards glass run channel 13.

Various techniques may be employed to secure the spring 20 in its operative location. For example, optionally a second receiving channel, or a dog-ear 39 or alternatively shaped projection extending generally perpendicular the base segment such as a mushroom cap may extend from a base segment of the second pin 35 to assist in captivation of the second end of the spring 22. Alternatively, the first end of the spring 21 can be mounted over the pivot pin 32 and the pivot pin end can be spin riveted. Additionally, combinations of such techniques may be employed to captivate the spring.

In previous regulator designs use of a stamped metal plate as a lift channel was found to be ineffective due to the difficulty holding the tolerances of the metal where it was crimped or bent over to form the slot. This allowed for rattling and chattering of the slider in the slot. With this design the problem of chattering is reduced or eliminated since the slider is continually biased against the lift channel.

In a highly advantageous feature, the spring 20 is mounted generally outboard a lower edge of the windowpane 10, and the drive arm 14 is mounted generally directly below the bottom edge of the windowpane 10. This reduces the distance between the drive arm 14 and the windowpane 10, thereby minimizing excessive moment loading on the glass run channels 12,13 by the windowpane 10 and the lift channel 36 by the slider assembly 30.

Figure 4:
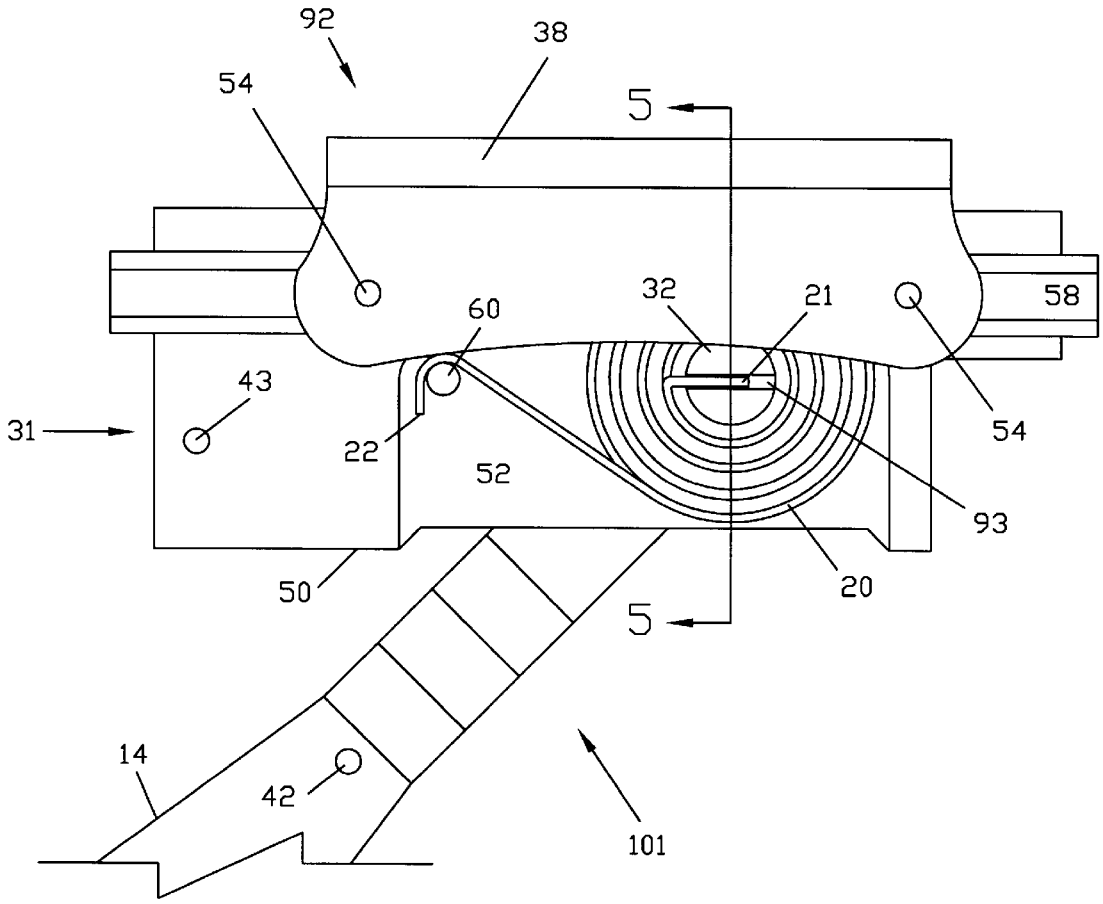
FIG. 4 is a elevation view of an alternative embodiment, revealing a slider run channel provided with a stamped spring receiving pocket.
Figure 5:
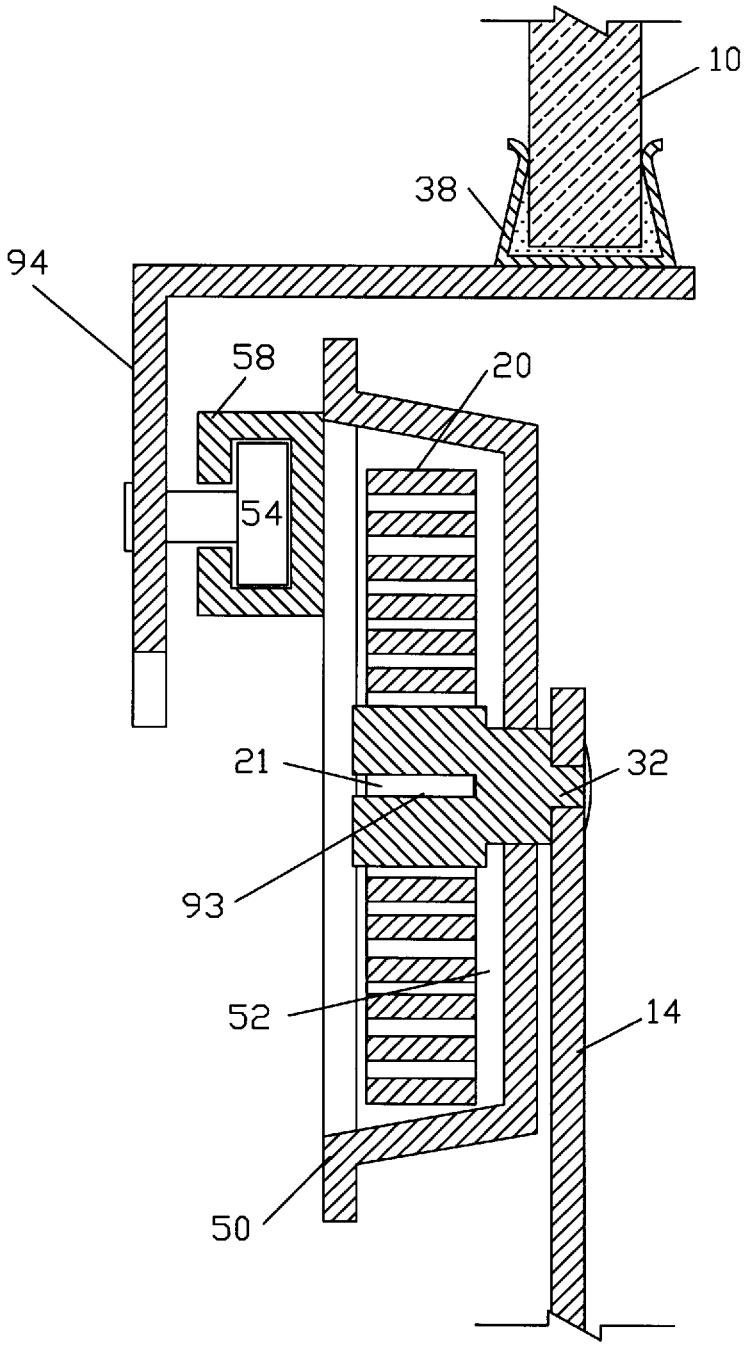
FIG. 5 is a cross sectional view taken along line 5—5 in FIG. 4.

Thus in the preferred embodiment shown in FIGS. 1–3, the spring 20, slider 34 and pivot pin 32 all slide in the slot 37 of the lift channel 36. In the alternative preferred embodiment shown in FIGS. 4 & 5, the slider assembly 31 is shown to comprise a pivot pin 32, glider plate 50 and C-channel 58. The glider plate 50 is rotatably mounted over the pivot pin 32, and the pivot pin 32 allows for adjustable attachment to the drive arm 14. The glider plate 50 may optionally have a spring mounting cavity 52 to receive the spring. The cavity 52 can be formed as part of a single stamping or alternatively the cavity 52 can be formed by having a separate piece attached by rivets or welded together or other suitably connecting means well known to those skilled in the art.

The spring 20 has a first end 21 mounted over a receiving channel 93 in the pivot pin 32 and a second end 22 biasingly mounted over a second pin 60 fixedly attached to the glider plate preferably at the spring mounting cavity 52. As in the previous embodiment the spring produces a biasing force on the slider assembly 31 which places rotational loading on the attachment assembly 92 to bias the top edge of the windowpane 10 laterally towards one of the glass run channels 13.

The attachment assembly 92 comprises an extended windowpane mounting bracket 94, optionally attached to the windowpane by adhesive, clips, or bolts, and at least one roller 54 mounted on the bracket 94. To improve the control of the regulator, it is preferred that a pair of rollers 54 are employed, one on either side of the pivot pin 32. The C-channel 58 receives the rollers 54, allowing the slider assembly 31 to move relative the attachment assembly 92. The C-channel 58, as shown in the Figs. is part of the slider assembly 31 and slides with the spring 20 and the glider plate 50 relative the attachment assembly. Alternatively, the C-channel 58 can be part of the attachment assembly 92 and the rollers 54 can be part of the slider assembly 31.

Figure 6A:
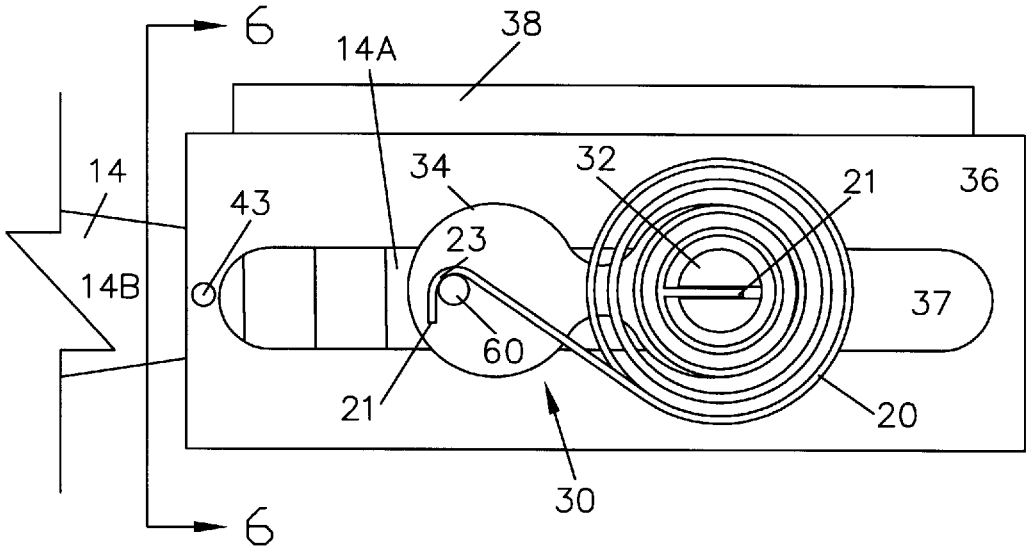
FIG. 6A is a elevation view of the preferred embodiment of FIGS. 1–3 showing the drive arm in a preferred ship position.
Figure 6B:
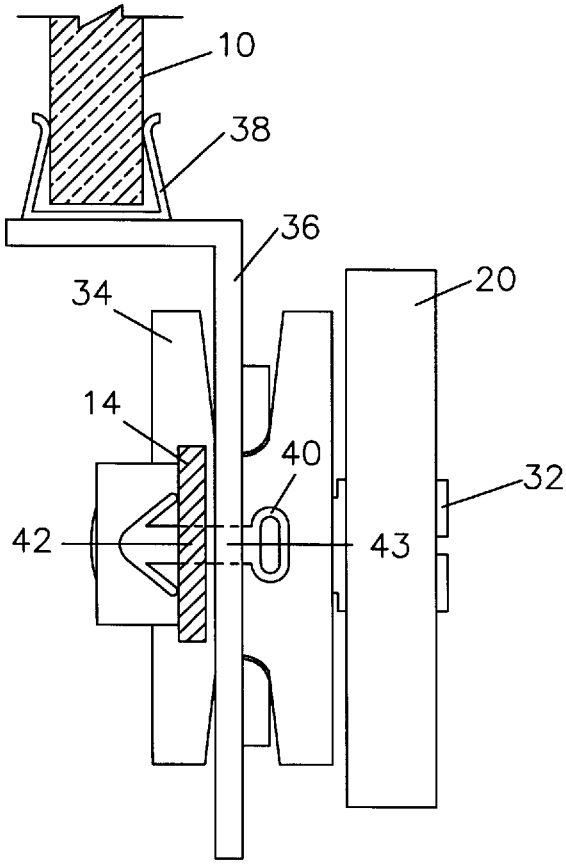
FIG. 6B is a cross sectional view taken along line 6—6 in FIG. 6A revealing means for releasably securing the slider assembly and biasing spring to the drive arm in a ship position.

Typical current production of automobiles involves several components and subassemblies produced independently of the final assembly line, commonly at locations remote from the final assembly line. The window regulator, for example, is formed as a preassembled unit and then shipped to the final assembly location where it is installed in the motor vehicle door and attached to the windowpane. As it is critical to minimize the amount of time required to assemble components to a vehicle in a mass production assembly line, it is preferable to assemble the window regulator in a fixed ship position to ensure consistent and repeatable assembly into the door and to facilitate attachment of the windowpane to the regulator and/or minimize the amount of space and packaging material required to ship the window regulator to the automobile assembly line. The ship position for the window regulator need not be the operating position in which the window regulator raises and lowers the windowpane. In a highly advantageous feature of this invention, FIGS. 6A & 6B show a portion of a rotationally biasing window regulator 100 in one preferred ship position, wherein the attachment means, which includes an attachment assembly 92 and a slider assembly 30 is mounted generally parallel with the drive arm. Optionally the attachment means can be mounted such that it is generally parallel with the bottom edge of the windowpane 10. Regardless, since the attachment means is biased by the spring 20, locking means are required for securing the attachment means to the drive arm 14. Preferably the drive arm 14 is provided with a hole 42, and the attachment assembly 92 or the slider assembly 30 is provided with a hole which, when the attachment means is rotated such that each hole 42,43 are aligned, a removable clip 43 is inserted through both holes. The clip 43 prevents the biasing force of the spring 20 from moving the attachment means until it is ready to be attached to the windowpane 10.

To facilitate attachment of the clip 43 and to minimize the length of the clip, the drive arm should be positioned as close to the attachment means as possible, while not interfering in its normal operation. This can be accomplished by having a drive arm 14 provided with several alternatively positioned portions unitarily connected to one another. In FIG. 6A, drive arm 14 has a first unitary portion 14A where the pivot pin 32 is mounted, and has a second unitary portion 14B positioned outboard of the first portion 14A, minimizing the distance between hole 42 and hole 43 while allowing the attachment means to operate unimpeded by the drive arm 14.

Alternative locking mechanisms, such as threaded holes receiving a screw, and alternative ship positions will be readily apparent to those skilled in the art.

Figure 7:
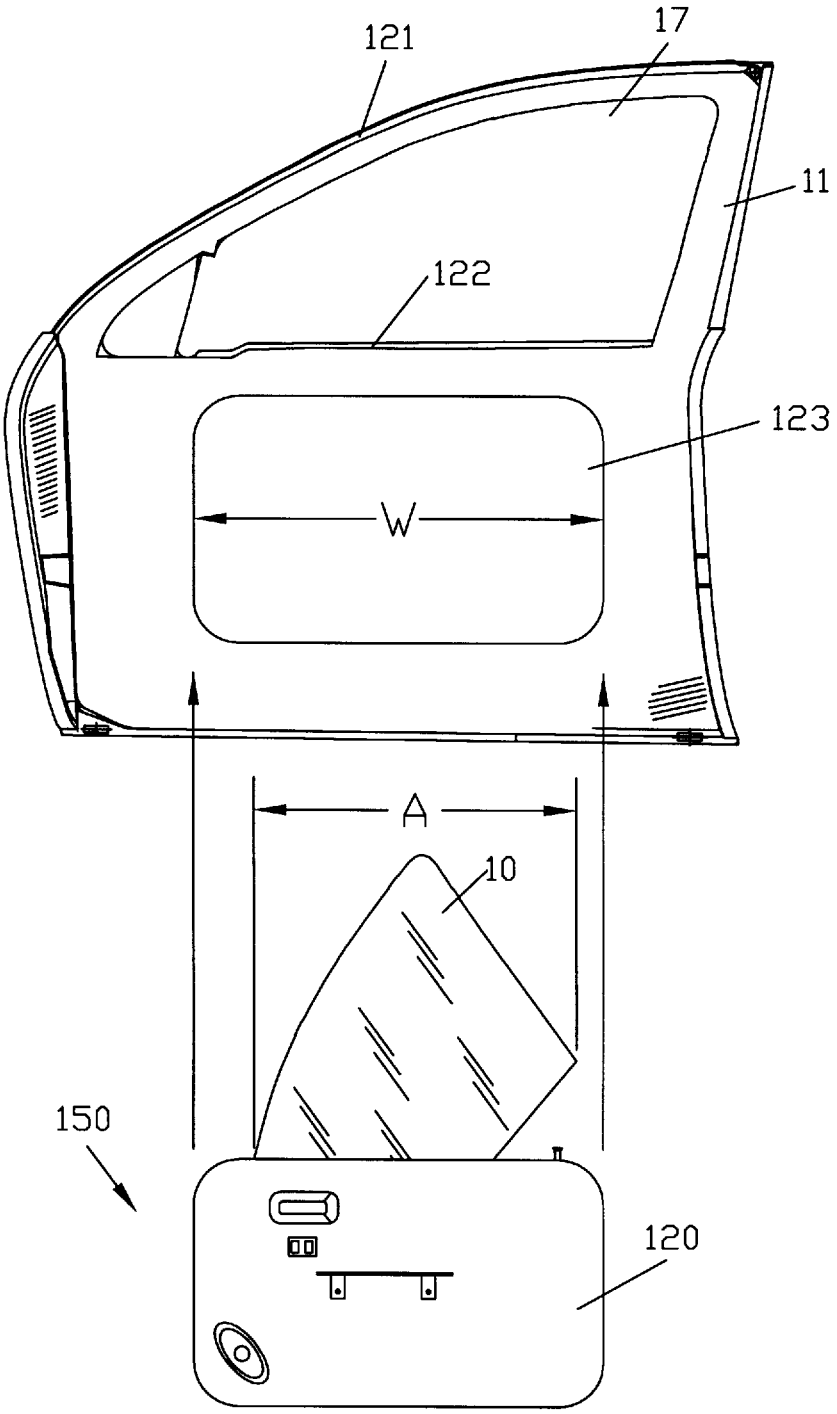
FIG. 7 is an exploded view of an alternative preferred embodiment of the invention, revealing the inboard side of a rotationally biasing door module design and the windowpane in a ship position with some components removed for clarity of illustration.
Figure 8:
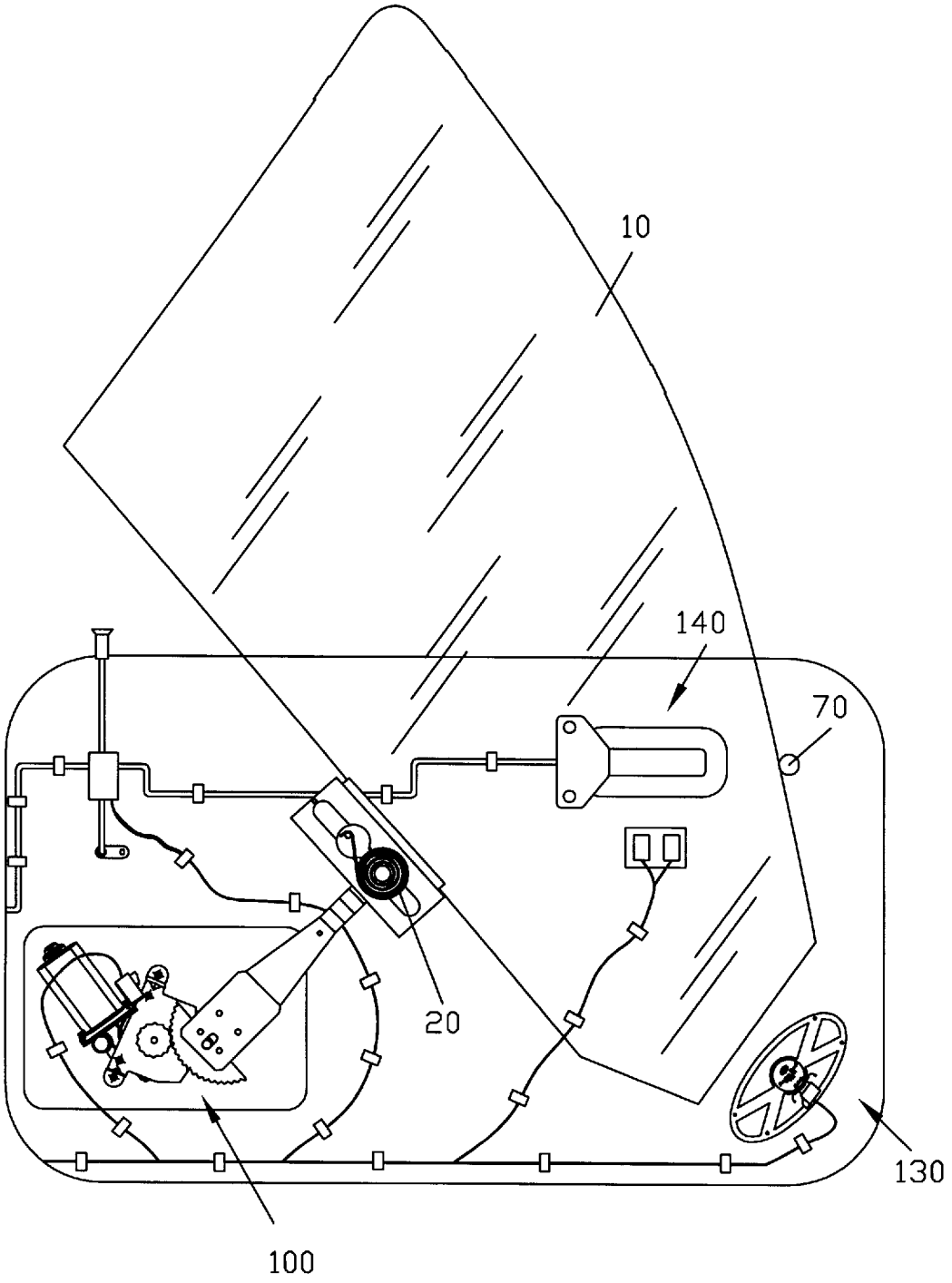
FIG. 8 is the reverse side of the door module of FIG. 7.

In an alternative preferred embodiment, as seen in FIGS. 7 & 8, a pre-assembled door module 150 is insertable into an opening in a motor vehicle door 11 is shown to comprise an inner panel which acts as a mounting surface for a rotationally biasing regulator 100 employing a spring 20 biasing a windowpane 10 in a laterally, as well as for at least one other functional hardware subassembly.

The regulator 100 may be an arm-and-sector type regulator as discussed above. In a highly advantageous feature allowing for ease of assembly, the windowpane 10 may be attached to the regulator 100 as part of the pre-assembled door module 150. The windowpane 10 can be releasably secured in a ship position by a catch 70 or other suitable means.

The door module 150 employing a rotationally biasing window regulator 100 is particularly advantageous in motor vehicle door designs wherein the glass run channels 12,13 are attached to the door 11, and the door is provided with a header 121 or frame which in combination with the beltline 122 defines an opening 17 closed by the windowpane, and an opening 123 of width "W" below the beltline to receive the door module. For current door designs with headers the windowpane is installed in the door through the windowpane opening 17. This invention allows the windowpane 10 to be attached to the door module 150 and installed through the door module opening 123 in the side of the door. In the ship position, the windowpane has a width "A" which is less than the width W of the door module opening 123, allowing for insertion of the door module 150 with the attached windowpane from below the beltline 122 of the motor vehicle door.

Functional hardware assemblies that may be mounted to the inner panel include, for example: an interior trim panel preferably formed of a structural urethane or S-RIM; latches, locks, handles and the linking mechanisms connecting these components 140; wire harnesses providing electrical connections to the rest of the vehicle; a side impact beam; airbag sensors; or a speaker and its wiring 130; or any combination of each or similar structures.

In view of the foregoing disclosure, those who are skilled in this area of technology will recognize that various modifications and additions can be made to the preferred embodiments discussed above without departing from the true scope and spirit of the invention. All such alternative embodiments are intended to be covered by the following claims.

What is claimed is:

1. A rotationally biasing regulator comprising, in combination:

drive means for producing a force for moving a windowpane;

single arm drive transmission means for transmitting the force for moving a windowpane, comprising a single drive arm having a first location fixedly attached to the drive means;

attachment means fixedly attachable to a windowpane for connecting the single drive arm to a windowpane; and a spring exerting a rotational biasing force on the attachment means, wherein a first end of the spring is mounted on the single drive arm at a second location, and a second end of the spring is mounted on the attachment means, operatively connecting the drive transmission means and the attachment means.

2. The rotationally biasing regulator of claim 1 wherein the attachment means and the drive transmission means are moveable between an operating position and a ship position, further comprising means for releasably securing the windowpane, attachment means and drive transmission means in the ship position.

3. The rotationally biasing regulator of claim 2 wherein the means for releasably securing the attachment means to the drive transmission means comprises:

alignable holes in the drive transmission means and the attachment means, the holes being aligned when the attachment means is in the ship position; and a clip removably insertable through the holes to releasably secure the attachment means to the drive transmission means in the ship position.

4. The rotationally biasing regulator of claim 1 wherein the drive transmission means further comprises a rotationally mounted sector gear receiving the force and directly engaging the single drive arm.

5. The rotationally biasing regulator of claim 4 wherein the drive arm is provided with at least a first portion attached to the attachment means, and a second portion unitary with the first portion extending towards the sector gear and positioned outboard of the first portion, wherein the second portion has means for releasably securing the attachment assembly in a ship position.

6. The rotationally biasing regulator of claim 4 wherein the attachment means comprises an attachment assembly fixedly attached to the windowpane and a slider assembly slidingly attached to the attachment assembly and operatively connected to the first end of the drive arm.

7. The rotationally biasing regulator of claim 6 wherein the attachment assembly comprises a windowpane mounting bracket and a lift channel fixedly attached to the windowpane mounting bracket and provided with a slot, and the slider assembly comprises a pivot pin mounted to one end of the drive arm, a slider rotatably mounted on the pivot pin and slidingly mounted in the slot of the lift channel, and a second pin fixedly attached to the slider which acts as a mount for the second end of the spring to receive the biasing force of the spring.

8. The rotationally biasing regulator of claim 7 wherein the slider comprises a pair of slider segments and the slider segments snap fit together.

9. The rotationally biasing regulator of claim 7 wherein the second pin has a base segment and a projection extending generally perpendicular to the base segment to assist securing the second end of the spring to the slider assembly.

10. The rotationally biasing regulator of claim 7 wherein the slider has pair of lift channel receiving valleys nesting over the lift channel at the slot, and the valleys allow the slider to pivot inboard and outboard relative the lift channel.

11. The rotationally biasing regulator of claim 6 further comprising the windowpane having a bottom edge, and wherein the spring is positioned generally outboard of the bottom edge of a windowpane.

12. The rotationally biasing regulator of claim 6 further comprising the windowpane having a bottom edge, wherein the first location of the drive arm is a first end rigidly attached to the sector gear, and the second location is a second end which is positioned generally directly below the bottom edge of the windowpane.

13. The rotationally biasing regulator of claim 6 wherein the attachment assembly comprises a windowpane mounting bracket and a pair of rollers attached to the windowpane mounting bracket, each roller positioned on one side of the spring, and the slider assembly comprises a pivot pin mounted to one end of the drive arm, a glider plate rotatably mounted over the pivot pin, and a C-channel fixed to the glider plate and receiving the rollers, wherein the first end of the spring is mounted over the pivot pin, and the second end of the spring is mounted over a second pin fixedly attached to the glider plate, exerting rotationally biasing force on the glider plate.

14. The rotationally biasing regulator of claim 13 wherein the glider plate has a spring mounting cavity and the first end of the spring is mounted in the glider plate spring mounting cavity over the pivot pin.

15. The rotationally biasing regulator of claim 14 wherein the second pin is mounted in the glider plate spring mounting cavity.

16. The rotationally biasing regulator of claim 6 wherein the attachment assembly comprises a windowpane mounting bracket and a C-channel and the slider assembly comprises:

a pivot pin adjustably mounted to one end of the drive arm; and a glider plate rotatably mounted over the pivot pin, having a pair of rollers that roll in the C-channel, and provided with a spring mounting cavity wherein the first end of the spring is mounted in the glider plate spring mounting cavity over the pivot pin, and the second end of the spring is mounted to the glider plate, rotationally biasing the glider plate.

17. The rotationally biasing regulator of claim 16 wherein the second end of the spring exerts biasing force on a pin rigidly attached to the glider plate.

18. A rotationally biasing regulator for controlling movement of a windowpane in a travel plane comprising, in combination:

drive means for producing a force to move the windowpane, comprising a drive motor having a pinion;

drive transmission means for transmitting the force to move the windowpane, comprising a sector gear engaging and rotated by the pinion and a drive arm rigidly connected to the sector gear;

an attachment assembly fixedly attachable to the windowpane for connecting the drive arm to the windowpane; and biasing means for exerting a rotational biasing force on the attachment means, having a first end mounted on the drive arm and a second end mounted on the attachment means, placing torque on the attachment means relative to the drive arm.

19. A motor vehicle door having an inner panel and an outer panel forming a support structure, comprising, in combination:

a pair of generally vertical glass run channels mounted to the support structure;

a windowpane having a top edge and a bottom edge, moveable from an open position to a closed position in the glass run channels;

drive means for moving the windowpane;

an arm-and-sector assembly comprising a sector gear rotatable by the drive means and a single drive arm rigidly attached to the sector gear;

an attachment assembly comprising an attachment bracket secured to the windowpane and a channel extending along at least a portion of the bottom edge of the windowpane;

a slider assembly slidably mounted in the channel and rotatably attached to the single drive arm; and a spring exerting a rotational biasing force on the windowpane, having a first end and a second end, connected at a first end to the single drive arm, and connected at a second end to the attachment assembly, placing torque on the attachment assembly relative the single drive arm and biasing the top edge of the windowpane in a lateral direction.

20. A pre-assembled door module for insertion into a vehicle door, comprising, in combination:

an inner panel which acts as a mounting surface; and a rotationally biasing regulator mounted to the mounting surface for controlling the motion of a windowpane, comprising, drive means for producing a force to move the windowpane, single arm drive transmission means for transmitting the force of the drive means to move the windowpane, comprising a sector gear rotatable by the drive means and a single drive arm rigidly attached to the sector gear;

attachment means for connecting the drive transmission means to the windowpane, and a spring producing a biasing force and having a pair of ends, wherein a first end of the spring is mounted on the single drive arm, and a second end of the spring is mounted on the attachment means, operatively connecting the drive transmission means and the attachment means and placing torque on the attachment means.

21. The pre-assembled door module of claim 20 further comprising at least one functional hardware subassembly in addition to the rotationally biasing regulator mounted to the mounting surface.

22. The pre-assembled door module of claim 20 further comprising the windowpane attached to the rotationally biasing regulator prior to installation.

23. The pre-asembled door module of claim 22 further comprising a header and a beltline, and the pre-assembled door module is insertable into a vehicle door from below the beltline.

24. The pre-assembled door module of claim 23 wherein means are provided for releasably securing the windowpane in the ship position.

* * * * *